United States Patent [19]

Cox

[11] 4,425,677

[45] Jan. 17, 1984

[54] SHOE CLEANER

[76] Inventor: James P. Cox, 246 E. Bartlett Rd., Lynden, Wash. 98295

[21] Appl. No.: 318,870

[22] Filed: Nov. 6, 1981

[51] Int. Cl.[3] ..... A47L 23/22

[52] U.S. Cl. ..... 15/104.92; 15/161; 15/216; 15/237; 15/238

[58] Field of Search ..... 15/104.92, 238, 239, 15/240, 215–217, 105, 112, 114, 161

[56] References Cited

U.S. PATENT DOCUMENTS

| | | | |
|---|---|---|---|
| 241,318 | 5/1881 | Dowler | 15/112 |
| 899,515 | 9/1908 | Delapp | 15/112 |
| 1,008,618 | 11/1911 | Skowronski | 15/216 |
| 1,271,094 | 7/1918 | Spickerman | 15/112 |
| 3,641,609 | 2/1972 | Hansen | 15/112 |
| 3,696,459 | 10/1972 | Kucera | 15/104.92 |
| 3,977,036 | 8/1976 | Vanyi | 15/104.92 X |

*Primary Examiner*—Edward L. Roberts

*Attorney, Agent, or Firm*—Hughes, Barnard & Cassidy

[57] ABSTRACT

A shoe cleaner for removing debris from the sole of a shoe is comprised of a foraminous scraper for contacting the sole of a shoe and, upon relative motion therebetween, removing debris therefrom and a wick member for applying a liquid deodorant and/or solvent for the debris to the shoe from a reservoir proximate the foraminous scraper. The shoe cleaner disclosed herein also preferably includes a mat for removal of any excess deodorant and/or solvent and for secondary removal of debris from the sole of the shoe.

11 Claims, 5 Drawing Figures

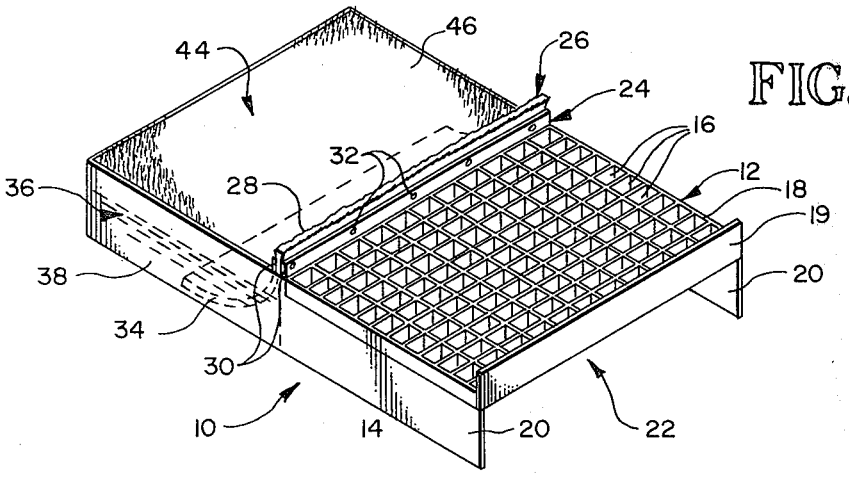
FIG. 1
FIG. 2
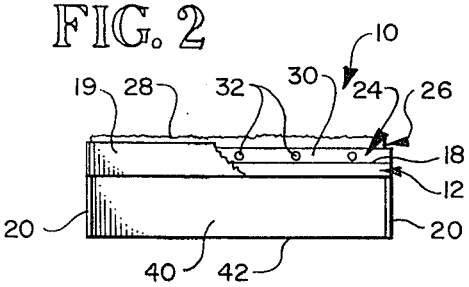
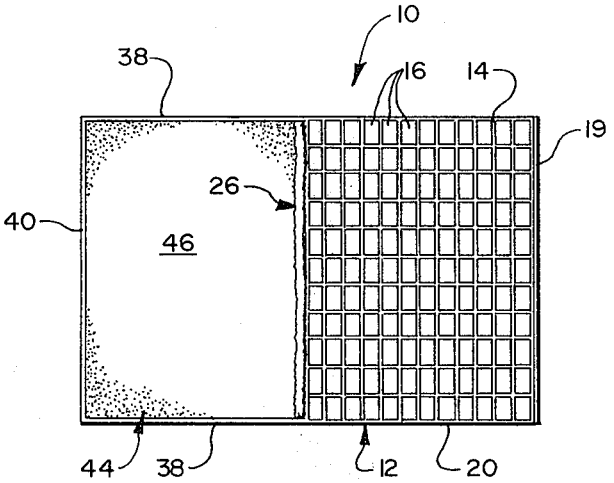
FIG. 3
FIG. 4
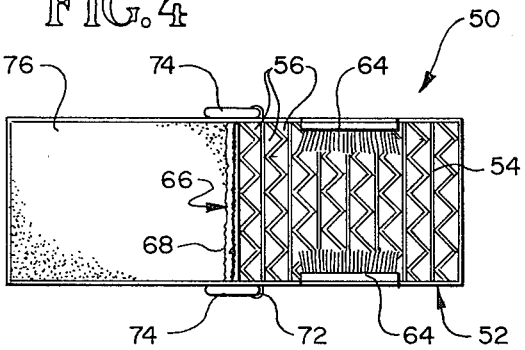
FIG. 5
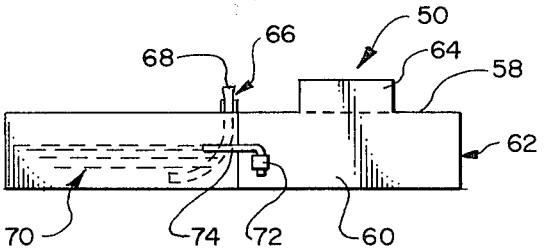

SHOE CLEANER

BACKGROUND OF THE INVENTION

1. Field of the Invention

The present invention relates, generally, to a shoe cleaner and, more especially, to one adapted for removal of organic debris from the sole of footwear.

2. Description of the Background Art

Boot and shoe scrapers of various configurations are commercially available for removal of debris from the sole of such footwear. A common variety consists simply of a frame having an upstanding bar or plate with an edge across which the sole of a boot or shoe can be scraped. Some such cleaners also include brushes disposed for contact with the edges and lower sides of the shoe while it is moved across the bar or plate scraper member. These devices work fairly well for removal of mud, dirt, or other crusty debris. Grate-type scraper devices, whether designed expressly for removal of debris from shoe soles or used in a more impromptu fashion by individuals with debris-laden footwear, have also been employed for cleaning the bottoms of shoes or boots. These grates work fairly well until the interstices thereof become filled with debris and then act, more commonly, as a source of contamination for the sole of footwear.

The problem of keeping footwear soles clean is particularly acute in industrial settings, and even more so around food processing plants. In food processing plants workers customarily wear heavy rubber or rubber soled boots which have a tendency to pick up offal or similar organic debris in and near the processing areas. When workers with contaminated footwear leave the processing area for other areas of the same plant there is, accordingly, a tendency to track this material.

To date there has yet to be devised an efficient shoe or boot scraper which will effectively remove debris, and particularly organic debris, from the sole of footwear.

SUMMARY OF THE INVENTION

The present invention advantageously provides means for the effective removal of debris from the sole of footwear including efficient means for the removal of stubborn organic debris. In one aspect of the present invention, particularly stubborn organic debris is loosened for removal by application of a suitable solvent therefor. In a related aspect of the invention, deodorizing compounds may be applied to the sole to mask or neutralize offensive odors which might otherwise be carried by the footwear due to contamination thereof.

These and other advantages are provided, in a preferred embodiment of the present invention, by a shoe cleaner which is comprised of a foraminous scraper means for contacting the sole of a shoe and, upon relative motion therebetween, remoal of debris therefrom, along with wick means for application of a deodorant and/or solvent for the debris to the sole of the shoe. One end of the wick means is disposed in a reservoir proximate the foraminous scraper and the other end is maintained in an application position whereby the sole of any shoe requiring decontamination may be simply wiped thereacross. In a particularly preferred embodiment, the shoe cleaner also comprises a mat for removal of any excess deodorant and/or solvent and for secondary removal of debris loosened by the liquid agent(s). The mat, which can be fabricated from any one of a number of suitable materials, may serve as an upper closure means for the reservoir containing liquid deodorant and/or solvent. Another optional but highly preferred feature of the present invention is a blade included on or near the foraminous scraper to remove debris from the arch area of the shoe or boot.

The foregoing and other advantages of the present invention will be appreciated more fully, and a greater understanding of the means by which same are provided will be gained, by reference to the following detailed description of the invention, taken in conjunction with the figures of drawing, wherein:

BRIEF DESCRIPTION OF THE DRAWINGS

FIG. 1 is an isometric view of a preferred embodiment of a shoe cleaner in accordance with the present invention;

FIG. 2 is an end elevational view of the shoe cleaner shown in FIG. 1;

FIG. 3 is a top plan view of the shoe cleaner shown in FIG. 1;

FIG. 4 is a top plan view of an alternate embodiment of a shoe cleaner in accordance with the present invention; and, FIG. 5 is a side elevational view of the shoe cleaner shown in FIG. 4.

DETAILED DESCRIPTION OF THE INVENTION

The present invention relates generally to shoe cleaners and, more especially, to shoe cleaners particularly adapted for removing organic debris from the sole of footwear such as the debris encountered by workers in the food processing industry. Accordingly, the invention will now be described with reference to certain preferred embodiments thereof adapted for use within the aforementioned context. However, those skilled in the art will appreciate that such a description is meant to be illustrative only, and should not be deemed limitative.

Referring to the figures of drawing, in all of which like parts are identified by like reference numerals, FIGS. 1–3 illustrate a preferred embodiment of a shoe cleaner in accordance with the present invention, designated generally as 10. The shoe cleaner 10 is comprised of a foraminous scraper means identified generally as 12. In the embodiment shown in FIGS. 1–3, foraminous scraper means 12 includes a grate 14 comprised of a plurality of cubelet foramina 16. The cubelets 16 provide an upper scraping surface 18 across which the sole of a boot or shoe may be moved to remove debris therefrom, which will then pass through the open foramina. A scraping blade or lip 19 is included at or near the end of the grate 14. The blade 19, preferably a stiff metal blade, is provided to permit removal of debris packed in the arch area of a shoe or boot, which is not easily removed by scraping across the grate 14.

It is preferred that the scraper 12 be elevated above the floor or ground on which the shoe cleaner 10 rests in order to facilitate complete passage of any debris through the foramina 16, lest the same be filled by repeated scraping applications and thereafter act as a tracking source as opposed to a tracking cure. Accordingly, the grate 14 is raised on side walls 20 a suitable distance to provide a collection or accumulation cavity 22 beneath the scraper means. Debris may be allowed to accumulate within the cavity 22 until such time as it is desirable to collect the same for ultimate disposal. In the preferred embodiment shown in FIGS. 1–3, the collection cavity 22 is open at the end so that accumulated debris can be removed either by means of a shovel or by application of water through a hose to the top surface of the scraper means 12 which will loosen and remove any clinging debris from the foramina 16 and wash that along with the accumulated debris within cavity 22 away from the shoe cleaner 10. Of course, depending on the desires of the user of the cleaner 10, the cavity 22 could be closed by providing a removable or hinged panel between the opposing walls 20. Likewise, the cavity could include a bottom wall either integral with the cleaner or in the form of a removable tray should such be desired.

Oftentimes it is difficult to remove stubborn organic material from the sole of a boot or shoe simply by scraping the same across the foraminous scraper 12. Also, regardless of the complete efficiency of the scraper, certain types of organic debris will contaminate the footwear and leave same bearing offensive odors. A wick means 24 is included within the shoe cleaner 10 for application of a liquid deodorant and/or solvent for the debris to be cleaned. Wick means 24 is comprised of a wick 26 fabricated from a fabric material capable of wicking a liquid substance and presenting same at a top edge 28 thereof. The edge or end 28 of the wick 26 is presented so that the footwear which has previously been scraped across the grate 14 may be wiped across edge 28 for application of a liquid deodorant and/or solvent for the debris. Depending upon the choice of material from which the wick 26 is made, it may be advantageous to provide stiffening means 30 to hold the edge 28 in a suitable and convenient position. As shown in FIGS. 1–3, the stiffener 30 is comprised of a pair of thin sheets of, e.g., metal or plastic sandwiching the wick 26. The opposing stiffeners 30 may be secured by any convenient means, such as fasteners 32 which might be, for example, metal screws. The stiffeners 30 will also add a measure of flexible resiliency to the wick 26. A particularly preferred material for the wick 26 is carpeting which is capable of acting as wicking material and also, by virtue of its weave, provide a measure of auxiliary debris removal as the footwear is rubbed against it. Other suitable materials might be employed for the purpose of liquid deodorant and/or solvent application to the sole of the footwear; in which case, depending upon the fiber characteristics, the stiffeners 30 might be eliminated or one or both provided with a roughened upper surface such as a slight sawtooth edge to augment the debris removal process.

Regardless of the absolute configuration of the stiffeners 30 or the material from which wick 26 is fabricated, the lower end thereof, designated 34, is disposed within a reservoir 36 which contains the liquid deodorant and/or solvent. Reservoir 36 is comprised of opposing side walls 38, end walls 40 and a bottom wall 42 which define the outer periphery of the reservoir. A closure means, designated generally as 44, completes the overall structure of reservoir 36.

In the preferred embodiment shown in FIGS. 1–3, closure means 44 also comprises a mat 46 for removal of any excess liquid applied to the shoe and secondary removal of loosened debris therefrom. The mat 46 may be made from any convenient material such as a fabric or could be a piece of artificial lawn material or conventional carpeting. Should the material from which mat 46 is fabricated be of insufficient rigidity to act itself as a cover for the reservoir 36, the same could be adhered to a suitable, rigid substrate such as wood or metal and the composite act as the closure for the reservoir.

The shoe cleaner 10 illustrated in FIGS. 1–3 is formed essentially as a somewhat unitary article. In other words, the reservoir 36 is formed as a generally rectalinear box open at the top where the side walls 38 are continuous and constitute the walls 20 upon which grate 14 is supported. A ridge may be included near the upper edges of the side walls 38 and extreme end wall 40 to form a lip upon which closure means 44 may rest. The closure means 44 is dimensioned or configured to allow for suitable passage of the wick 26 from its location proximate foraminous scraper 12 down within the liquid housed in reservoir 36. The scraper 14 itself may be secured to the arms 20 by means of fasteners or, depending upon the material from which the cleaner is made, by weldments. The lip or blade 19 may be attached to the grate 14 in a similar way. Accordingly, a completely self-contained shoe cleaner is provided in a durable, rugged construction.

FIGS. 4 and 5 illustrate an alternate embodiment of a shoe cleaner in accordance with the present invention, designated generally as 50. The shoe cleaner 50 is comprised of a foraminous scraper means 52 which, in this embodiment, is a metal grate 54 having foramina 56, the top surface of which defines a scraping surface 58. The overall geometry of the grate 54 differs from that of the grate 14 described above, but otherwise serves an identical function of removing encrusted or heavy deposits of debris from the sole of a shoe or boot. Again, in this alternate embodiment the scraper 54 is raised by walls 60 to provide an accumulation cavity 62 within which debris will reside following an initial scraping operation. Cleaner 50 also includes a pair of brushs 64 which will serve to remove any debris clinging to the edges of the sole or the lower portions of the footwear to be cleaned. As shown in FIGS. 4 and 5, the brushs 64 are positioned at the sides of the scraper means 52, but their exact placement on the cleaner 50 is not crucial. In some cases, only a single brush may be necessary or desirable, in which case it can be positioned at any convenient place on the grate 54. Wick means 66, essential identical to wick means 24 described above, includes an upper edge 68 appropriate positioned for application of liquid contained within a reservoir 70.

In the alternate embodiment, the shoe cleaner 50 is comprised of two separate units, whereby the reservoir 70 is a separate component from the overall structure of the foraminous scraper 52. In order to maintain the same in suitable relative positioning, a pair of eyelets 72 are included on either side wall 60 of the scraper 52, while corresponding pins 74 are associated with the reservoir structure 70 for receipt within the eyelets. Thus, while the two components may be separated for cleaning, storage, or whenever otherwise desirable, the two components function as a substantially unitary device when assembled into the relationship shown in the figures. As with the embodiments disclosed above, the reservoir 70 has a closure member 76 which is, most preferably, a mat which will remove any excess liquid deposited via wick means 66 as well as debris loosened by that liquid material.

In operation, the shoe cleaner of the present invention, whether it be in the embodiment of FIGS. 1–3 or 4–5, is convenient and yet highly efficient. The bulk of debris on the sole of the footwear to be cleaned is removed by initial scraping across the foraminous scraper means, through which is passes to the accumulation cavity directly beneath the scraper. Any debris packed within a recessed arch area, prominent in some shoe or boot designs, may be conveniently removed by scraping across the upstanding blade proximate the foraminous scraper. Should any of the debris removed from the shoe tend to cling within the foramina of the scrapers, subsequent scraping operations will have a tendency to express that clinging material through the scraper by virtue of the downward pressure of subsequently-removed debris. Accordingly, the upper scraping surface of the shoe cleaner remains relatively free from debris thereby minimizing the tendency for the device to become a tracking source. Once the bulk of debris is removed via the foraminous scraper, the sole is then wiped in contact across the wick means which deposits a liquid deodorant and/or solvent for the debris. Depending on the material from which the wick is made, and the optional presence of a sawtooth or scraper edge on the stiffener supporting that wick, there may also occur a slight cleaning operation as liquid is deposited. Regardless of that eventuality, the remaining debris on the sole of the footwear will tend to be loosened even if the liquid housed within the reservoir is not a solvent but only a deodorant. Certainly, where a solvent is applied it will act to loosen that remaining debris. The sole is then wiped or scrubbed across the upper surface of the mat adjacent the wick location where any excess liquid is removed along with whatever debris has been loosened by the liquid application. For particularly stubborn debris, one might apply the liquid and go back to the foraminous scraper, then deposit further liquid before final cleaning on the mat.

After the shoe cleaner of the present invention has been in use there will be occasions to remove accumulated debris from beneath the scraper. The accumulation cavity can be provided with a tray to facilitate removal or, if the cleaner is used out of doors, accumulated debris within the cavity along with any clinging debris with the foraminous scraper may be simply washed away by use of a hose. Likewise, continuous or repeated use will deplete the liquid deodorant and/or solvent within the reservoir 36, which may be replenished simply by removal of the mat/closure means. In sum, the instant shoe cleaner (in either of its disclosed embodiments) provides a very convenient yet highly efficient and durable device for removal of even the most stubborn debris from the sole of footwear.

While the invention has now been described with reference to certain preferred embodiments thereof and suggested application therefor, theose skilled in the art will appreciate that various substitutions, modifications, omissions, and changes may be made without departing from the spirit thereof. Accordingly, it is intended that the scope of the present invention be limited solely by that of the following claims.

What is claimed is:

1. A shoe cleaner for removing debris from the sole of a shoe, comprising:

(a) foraminous scraper means for contacting the sole of a shoe and, upon relative motion therebetween, removing debris therefrom;

(b) wick means for applying a deodorant and/or solvent for said debris to said sole, said wick means having a first end disposed in a reservoir for said deodorant and/or solvent and a second application end disposed proximate said foraminous scraper means; and, (c) mat means proximate said wick means for removal of any excess deodorant and/or solvent and for secondary removal of debris from said sole, wherein said mat means comprises closure means for said reservoir.

2. The shoe cleaner of claim 1, wherein said wick means is secured at its second end to at least one stiffener.

3. The shoe cleaner of claim 2, wherein said second end of said wick means is disposed intermediate two stiffeners.

4. The shoe cleaner of claim 2 or 3, wherein said at least one stiffener is formed with a sawtooth edge disposed for contact with said sole.

5. The shoe cleaner of claim 1, wherein said foraminous scraper means is comprised of a metal grate raised on leg means.

6. A shoe cleaner for removing debris from the sole of a shoe, comprising a raised foraminous metal grate supported generally horizontally above a debris cavity, said grate providing scraping means for removal of debris from said sole; a reservoir having upstanding side and end walls, a bottom wall and closure means, for containing a liquid deodorant and/or solvent for said debris, said reservoir disposed proximate said grate; a wick having its first end disposed within said reservoir and its second end disposed generally vertically upright intermediate said grate and said reservoir; and a mat for removal of any excess liquid and for secondary removal of debris, said mat comprising said closure means.

7. The shoe cleaner of claim 6, wherein said metal grate is a generally rectangular grate supported along two edges by supporting side walls coincident with the side walls comprising said reservoir and said debris cavity is bounded by said grate, said supporting side walls and an end wall of said reservoir.

8. The shoe cleaner of claim 7, further comprising at least one stiffener secured to said cleaner and the upright end of said wick, for supporting said wick in a generally vertical position, the height of said plate being equal to or less than the vertical projection of said wick above the scraping surface of said grate.

9. The shoe cleaner of claim 8, wherein at least one of said stiffeners is formed with a sawtooth edge for contacting said sole.

10. The shoe cleaner of claims 6 or 1, further comprising brush means for contacting the side(s) of said shoe.

11. The shoe cleaner of claims 6 or 1 further comprising an upstanding blade proximate said scraper means for removal of debris within the arch area of a shoe.

* * * * *